United States Patent [19]

Allekotte

[11] Patent Number: 4,575,036

[45] Date of Patent: Mar. 11, 1986

[54] ADVERTISING STAND

[76] Inventor: Heinz Allekotte, Pestalozzistrasse 28, 5000 Köln, Fed. Rep. of Germany

[21] Appl. No.: 639,018

[22] Filed: Aug. 9, 1984

[30] Foreign Application Priority Data

Aug. 23, 1983 [DE] Fed. Rep. of Germany ... 8324149[U]

[51] Int. Cl.[4] ..... G09F 15/00

[52] U.S. Cl. ..... 248/289.3; 248/608; 40/608

[58] Field of Search ..... 248/608, 609, 289.3, 248/638; 40/606–608

[56] References Cited

U.S. PATENT DOCUMENTS

| | | | |
|---|---|---|---|
| 1,775,517 | 9/1930 | Flintermann | 248/609 |
| 2,292,536 | 8/1942 | McCabe | 248/609 |
| 2,414,954 | 1/1947 | Kalter | 248/609 |
| 4,265,040 | 5/1981 | Sarkisian | 40/606 |
| 4,365,435 | 12/1982 | Snyder | 248/289.3 |

*Primary Examiner*—Reinaldo P. Machado
*Assistant Examiner*—Alvin Chin-Shue
*Attorney, Agent, or Firm*—Diller, Ramik & Wight

[57] ABSTRACT

The disclosure is directed to an advertising stand defined by a pedestal and a frame, the pedestal including a pair of legs bridged by a strut and the frame being adapted to receive therein a poster or the like, a pair of L-shaped brackets carried by the strut and a pair of generally vertically disposed brackets carried by the frame, the frame and strut brackets having sandwiched therebetween elastomeric bodies for torsionally elastically connecting the frame to the pedestal whereby the frame is adapted to assume a tilted position relative to the pedestal by elastic deformation of the elastomeric bodies due to the force of wind or the like.

11 Claims, 6 Drawing Figures

ADVERTISING STAND

This invention is directed to a novel advertising stand or post which includes a pedestal and an upright frame interconnected through elastomeric spring elements. The frame carries a poster or like advertising material and is capable of assuming an inclined position relative to the vertical or to the pedestal by elastomeric deformation of the spring elements when the frame is subject to the force of wind.

In a known advertising stand or post of this type (German Pat. No. 21 11 338) a post or frame is secured to the upper ends of two vertical helical springs while the lower ends of the latter are firmly mounted to a pedestal. If wind acts on the frame or poster or like material carried thereby, the frame will assume an oblique or inclined position while the pedestal remains unchanged upon its supporting surface. If the frame is tilted or inclined by the wind, the two helical springs are so deformed that their longitudinal axes normally extend vertically and assume an arcute or bent shape. At the same time while the external winding portions of the springs are separated from one another, the inner winding portions are compressed. To avoid continuous rocking movements of the upright frame the windings of the helical springs of the known advertising stand are adjoined under pressure to obtain a certain prestressing.

The known advertising stand or post comprising such helical springs to obtain the inclined position of the frame are undesired because of potential fatigue and rupture of the metallic helical springs over a period of extended use. In spite of the prestressing of the springs heretofore noted, the constant rocking movement of the frame relative to the pedestal under wind action causes metal fatigue and subsequent failure of the springs. Even in the absence of external forces, such as the force of wind latter-noted, the frames assume an oblique position simply because of their weight. Furthermore, there is always the risk of fracture of the metallic helical springs which thus need to be replaced frequently to avoid a high expenditure in material and wages. There is no doubt, of course, that the production of helical springs, particularly prestressed metallic helical springs is expensive from both a material and a production (waste) standpoint.

In accordance with the latter it is a primary object of the present invention to provide a novel advertising stand or post of the above-mentioned type which through a simple construction the risk of fatigue and fracture of metallic spring elements is totally eliminated. In order to solve the latter problem, the invention provides that the conventional metallic helical spring elements are totally eliminated and in lieu thereof there are horizontally mounted torsional elastomeric bodies which are connected at end faces nonrotatably one to a pedestal and one to a frame, thus permitting the frame to tilt or cock relative to the pedestal through elastic deformation of the elastomeric bodies.

By virtue of eliminating the metallic helical spring elements which are subjected to bending and shearing stress, the elastomeric bodies are simply twisted under stress or subjected to torsion. The risk of fracture is virtually nonexistent in the sense of metallic springs fracturing and, of course, the torsional stress is distributed relatively uniformly over the entire volume of the elastomeric bodies thus avoiding nearly complete local peak stresses. As a result thereof, the risk of material fatigue and material failure is virtually eliminated and at worst, tremendously reduced. Normally, such helical springs are positioned vertically and the upper ends are thus laterally swiveled or twisted and are thereby subjected to high peak stress in the same regions, namely, at the outside of the deflection in the central range in the longitudinal direction of the spring. This undesired high peak stress in conventional metallic helical springs is therefore avoided and there is a more uniform distribution of stress through the entirety of the elastomeric bodies of the present invention which are essentially totally subject to uniform portion. Obviously, elastomeric bodies of this type are of simple design and can be produced at extremely low cost.

According to a preferred embodiment of the present invention faces or end sides of elastomeric bodies which face inboard are connected to the pedestal while those faces or sides of elastomeric bodies which face outwardly are joined to the frame. Thus the elastomeric bodies are provided beneath the frame without projecting laterally beyond the plane of the frame's sides edges or beyond the pedestal associated therewith.

The elastomeric bodies utilized with the stand of the invention may be rubber buffers such as the damping elements or engine mounts used in the automotive manufacturing industry. The axial faces or end sides of the rubber buffers or damping elements are easily bonded/-cured to plates which can be connected to the frame and pedestal or folders thereof by screws, bolts, or an appropriate adhesive or bonding material. Additionally, the pedestal holders are generally in the form of L-shaped brackets having one leg mounted to a strut of the pedestal and the opposite (vertical) legs permanently bonded or mounted to each elastomeric body.

With the above, and other objects in view that will hereinafter appear, the nature of the invention will be more clearly understood by reference to the following detailed description, the appended claims and the several views illustrated in the accompanying drawing(s).

A novel advertising stand or post as best illustrated in FIGS. 1–4 of the drawings and includes a rectangular frame 10 defined by profile bars or sides 11 which receive a poster 12 or like advertising material. The frame 10 normally assumes a vertical position relative to a pedestal 13, as is clearly illustrated in FIGS. 1–3 of the drawings.

Figure 1:
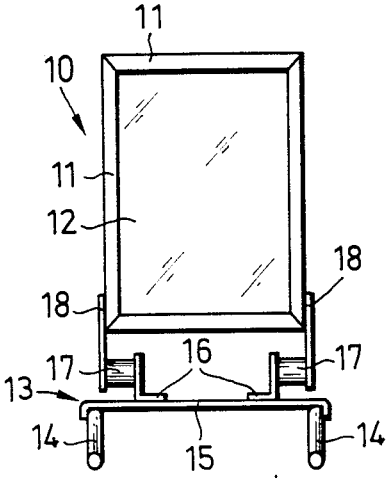
FIG. 1 is a front elevational view of a novel advertising stand constructed in accordance with this invention and illustrates a frame and pedestal united to each other by a pair of elastomeric bodies having faces bonded to holders or brackets of the frame and pedestal.
Figure 2:
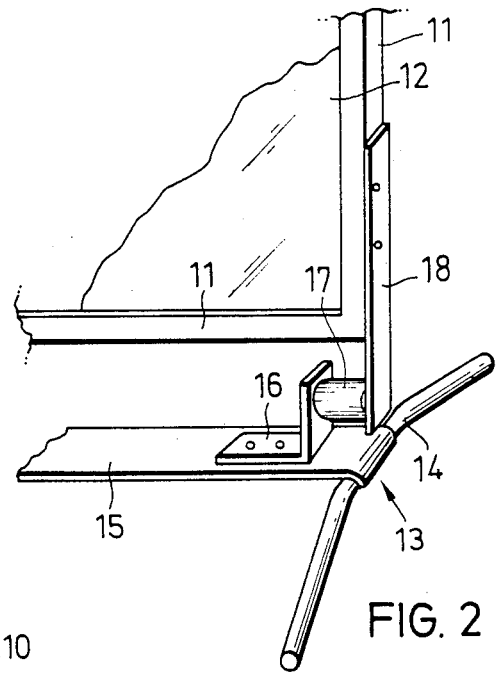
FIG. 2 is an enlarged perspective detail view of a lower end of the advertising stand of FIG. 1, and illustrates in more detail one of the elastomeric bodies, the holders and the frame and pedestal.
Figure 3:
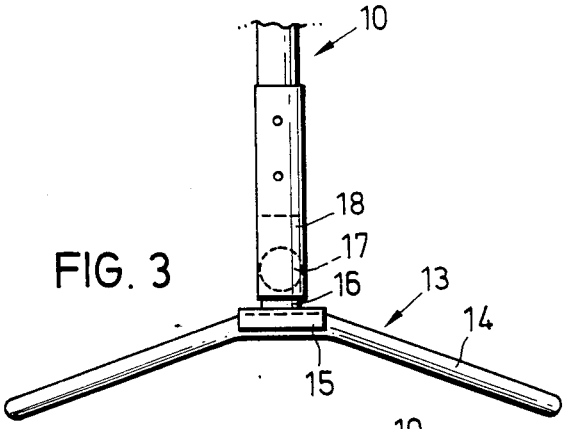
FIG. 3 is a fragmentary side view of the advertising stand, and illustrates the frame in its normally upright (vertical) position.
Figure 4:
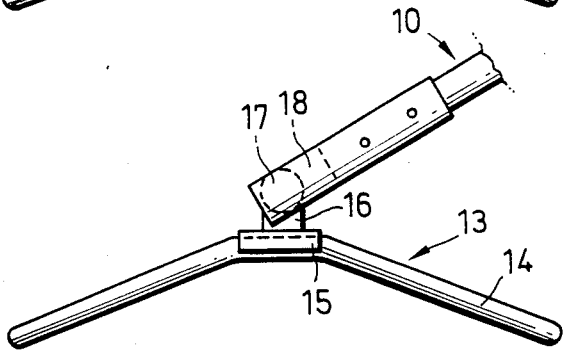
FIG. 4 is a fragmentary side view similar to FIG. 3 but illustrates the manner in which the frame has been moved to an inclined position to the vertical at which time the elastomeric bodies are torsionally deformed.

The pedestal 13 includes a pair of legs or bows 14, 14 which are slightly angulated (see FIGS. 3 and 4) and open in a generally downwardly facing direction. The bows or legs 14, 14 are interconnected by a strut or beam 15 located centrally of the ends of the legs or bows 14, 14 as is best illustrated in FIGS. 3 and 4 of the drawing.

Two generally L-shaped angular holders or brackets 16 have lower horizontal legs (unnumbered) fixed to the upper side (unnumbered) of the strut 15 while the vertical legs, (also unnumbered) of the holders or brackets are firmly secured to axially end faces or sides of elastomeric elements or bodies 17 defining elastomeric means for torsionally elastically connecting the frame 10 to the pedestal 13.

The vertical profile bars 11 of the frame 12 carry vertical brackets or holders 18 which are similarly fixed to the outwardly facing faces or sides of the elastomeric bodies, elements or means 17. By positioning the angular holders 6 inboard of the holders 18, the totality of the rectangular frame 10 is maintained within the contour of the pedestal 13 or, stated otherwise, the distance between the holders 18, 18 (FIG. 1) is less than the distance between the bows 14, 14 or the length of the strut 15. Thus, the entirety of the frame 10 is located inboard of the bows 14, 14 and thus cannot be inadvertently or accidentally bumped and/or moved. Not only are the elastomeric body 17, 17 preferably adhesively bonded and/or cured to the angular holders 16, 18, but the latter are also adhesively bonded or cured to the respective strut 15 and vertical profile bars 11. In lieu of the latter, the holder 16, 18 may instead be spot-welded, riveted or attached by screws or bolts to the strut 15 and/or the vertical profiles 11 of the frame 10.

Because of the relatively light weight of the frame 10 and the poster 12, the shear stress as exerted on the elastomeric bodies 17 is relatively low. If wind acts on the poster 12 the frame 10 will take on oblique or inclined position up to nearly 90° at a maximum, as illustrated somewhat in FIG. 4, in which the elastomeric bodies 17 are shown torsionally stressed or twisted about their concentric longitudinal axes. In other words, the outer holders or brackets 18 are turned relative to the inner holders or brackets 16 about the common axis of the elastomeric elements or bodies 17. Obviously, if the wind force ceases the frame 10 under the elastic restoring effect of the elastomeric bodies 17 again moves the frame 10 to the vertical position shown in FIG. 3.

Figure 5:
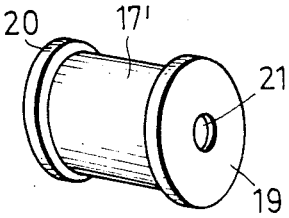
FIG. 5 is a perspective view of a modified elastomeric spring element or buffer, and illustrates end plates bonded thereto for securing the same to the frame and pedestal.
Figure 6:
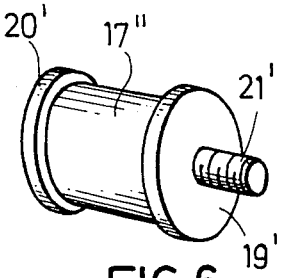
FIG. 6 is a perspective view of another embodiment of the elastomeric bodies and illustrates a pair of plates carried thereby each of which includes a threaded bolt for securing the elastomeric body to the frame and pedestal.

While the holders or brackets 16 and 18 of the embodiment of FIGS. 1–4 are firmly connected to the elastomeric bodies or elements 17 from which they cannot be separated without destruction, FIGS. 5 and 6 show respective elastomeric bodies 17′, 17″ which have metal end plates 19, 20 and the 19′, 20′ connected to the elastomeric bodies 17′, 17″ by a cured adhesive bond. The plates 19, 20 each contain coaxially aligned threaded holes 21 (FIG. 5) while the plates 20′, 21′ carry axially aligned oppositely directed threaded bolts, thus in keeping with the elastic bodies of FIG. 5, threaded bolts can be passed through holes (not shown) of the holder 16, 18 and threaded in the threaded bores 21 of the plates, 19, 20. In the case of the elastomeric body 17″, the bolts 21′ are passed through the holes (not shown) of the bracket 16, 18 and secured thereto by nuts (not shown) threaded to the threaded bolts 21′.

Although in a preferred embodiment of the invention as has been specifically illustrated and described herein, it is to be understood that minor variations may be made in the apparatus of without departing from the spirit and scope of the invention as defined in the appended claims.

I claim:

1. A stand comprising a pedestal and a frame, said frame including opposite lateral upstanding edges, an upper edge and a lower edge; horizontally disposed elastomeric means for torsionally elastically connecting said frame to said pedestal whereby the frame is adapted to assume a tilted position relative to the pedestal by elastic torsional deformation of said elastomeric means due to the force of wind or the like, said elastomeric means being a pair of generally horizontally aligned elastomeric bodies disposed between said lower edge and said pedestal, each body having opposite terminal faces, a plate bonded to each face, means for nonrotatably securing said opposite terminal face plates of each body one each to said pedestal and said frame opposite lateral upstanding edges, each said body terminal face plates being defined by respective inner and outer face plates, bracket means between said lower edge and pedestal and within an area set-off by downwardly imaginary projections of said frame lateral edges whereby said pair of bodies are generally unobtrusively disposed within said area, said bracket means including a first bracket projecting downwardly and a second bracket projecting upwardly from each frame lateral edge and pedestal respectively, each said first and second brackets being vertically aligned with each other when said frame is in a generally upright position thereof, and means for connecting said inner and outer plates to respective ones of said second and first brackets.

2. The stand as defined in claim 1 wherein said connecting means is a hole in each of said plates.

3. The stand as defined in claim 1 wherein said connecting means is a threaded stud projecting generally axially from each of said plates.

4. The stand as defined in claim 1 wherein each first bracket is secured to a lateral edge of said frame.

5. The stand as defined in claim 1 wherein each second bracket is of a generally L-shaped configuration.

6. The stand as defined in claim 1 wherein each second bracket is of a generally L-shaped configuration defined by a vertical and a horizontal leg, and said vertical legs are vertically aligned with each other and said first brackets when said frame is in the generally upright position thereof.

7. The stand as defined in claim 4 wherein each second bracket is of a generally L-shaped configuration.

8. The stand as defined in claim 6 wherein each elastomeric body is disposed between an associated first bracket and vertical leg.

9. The stand as defined in claim 8 wherein said connecting means includes a hole in each of said plates.

10. The stand as defined in claim 8 wherein said connecting means includes a threaded stud projecting generally axially from each of said plates.

11. The stand as defined in claim 9 wherein said horizontal legs are disposed in a generally common horizontal plane.

* * * * *